US010994561B2

(12) United States Patent
Suzuki

(10) Patent No.: US 10,994,561 B2
(45) Date of Patent: May 4, 2021

(54) HEAD DEVICE, HEAD POSITION ADJUSTMENT MECHANISM, AND IMAGE FORMING APPARATUS

(71) Applicant: Isamu Suzuki, Kanagawa (JP)

(72) Inventor: Isamu Suzuki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/585,127

(22) Filed: Sep. 27, 2019

(65) Prior Publication Data

US 2020/0101777 A1 Apr. 2, 2020

(30) Foreign Application Priority Data

Sep. 28, 2018 (JP) ..... JP2018-184841
May 31, 2019 (JP) ..... JP2019-102869

(51) Int. Cl.
*B41J 25/00* (2006.01)
*B41J 25/308* (2006.01)
*B41J 2/145* (2006.01)

(52) U.S. Cl.
CPC ..... *B41J 25/006* (2013.01)

(58) Field of Classification Search
CPC .. B41J 25/308; B41J 25/3082; B41J 25/3088; B41J 25/3086; B41J 2/145
See application file for complete search history.

(56) References Cited

U.S. PATENT DOCUMENTS

2006/0056896 A1* 3/2006 Boisdon ..... B41J 2/32 400/120.16
2017/0057262 A1* 3/2017 Takada ..... B41J 2/45
2019/0061396 A1 2/2019 Suzuki

FOREIGN PATENT DOCUMENTS

JP 2009-012249 1/2009
JP 2010-228434 10/2010
JP 2013-052526 3/2013
JP 2013-053608 4/2013

* cited by examiner

*Primary Examiner* — Jason S Uhlenhake
(74) *Attorney, Agent, or Firm* — Xsensus LLP

(57) ABSTRACT

A head device includes a head and a holder. The head has a discharge port to discharge droplets to a medium. The holder is configured to hold the head and be rotatable about a first rotation shaft extending in a discharge direction of the droplets and rotatable about a second rotation shaft extending in a longitudinal direction of the head.

15 Claims, 7 Drawing Sheets

HEAD DEVICE, HEAD POSITION ADJUSTMENT MECHANISM, AND IMAGE FORMING APPARATUS

CROSS-REFERENCE TO RELATED APPLICATIONS

This patent application is based on and claims priority pursuant to 35 U.S.C. § 1.19(a) to Japanese Patent Application Nos. 2018-184841, filed on Sep. 28, 2018, and 2019-102869, filed on May 31, 2019, in the Japan Patent Office, the entire disclosure of each of which is incorporated by reference herein.

BACKGROUND

Technical Field

The present invention relates to a head device, a head position adjustment mechanism, and an image forming apparatus.

Related Art

In recent years, an image forming apparatus used for outputting digitized information has become an indispensable device. Known examples of such an image forming apparatus include an inkjet printer. The inkjet printer includes an inkjet head that discharges liquid ink or the like as droplets to a sheet-like recording medium (sheet of paper or the like) being conveyed.

Conventionally, there have been known different types of inkjet printers having a difference in the configuration of their inkjet heads. An inkjet printer that performs high-speed printing has adopted a "line head system" in which an inkjet head is arranged in a manner to face the recording medium and arrayed in plurality in a direction orthogonal to a conveyance direction of the recording medium. The line head system inkjet printer executes an image forming process without interrupting conveyance of the recording medium.

An inkjet printer having a relatively low printing speed adopts a "serial head system" in which ink droplets are discharged while sliding the inkjet head in the direction orthogonal to the conveyance direction of the recording medium. A serial head type inkjet printer executes an image forming process so as to convey a recording medium intermittently and discharge ink droplets when the recording medium is stopped.

Conventional inkjet printers adjust and maintain the array direction of the nozzles being ink droplets discharge port and the movement direction of the inkjet head so as to be orthogonal to the conveyance direction of the recording medium.

SUMMARY

In an aspect of the present disclosure, there is provided a head device that includes a head and a holder. The head has a discharge port to discharge droplets to a medium. The holder is configured to hold the head and be rotatable about a first rotation shaft extending in a discharge direction of the droplets and rotatable about a second rotation shaft extending in a longitudinal direction of the head.

In an aspect of the present disclosure, there is provided a head device that includes a head, a first holder, a second holder, and a third holder. The head has a discharge port to discharge droplets to a medium. The first holder is configured to hold the head. The second holder is configured to hold the first holder. The third holder is configured to hold the second holder. The second holder is rotatable, with respect to the third holder, about a first rotation shaft extending in a first direction. The first holder is rotatable, with respect to the second holder, about a second rotation shaft extending in a second direction different from the first direction.

In still another aspect of the present disclosure, a head position adjustment mechanism configured to adjust a position of a head device including a head. The head includes discharge ports to discharge droplets onto a medium. The head position adjustment mechanism includes a first rotation shaft and a second rotation shaft. The first rotation shaft serves as a fulcrum of rotation to alter, with respect to the medium, a direction in which the discharge ports are arrayed. The second rotation shaft serves as a fulcrum of rotation to incline, with respect to the medium, a nozzle surface in which the discharge ports are arrayed.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
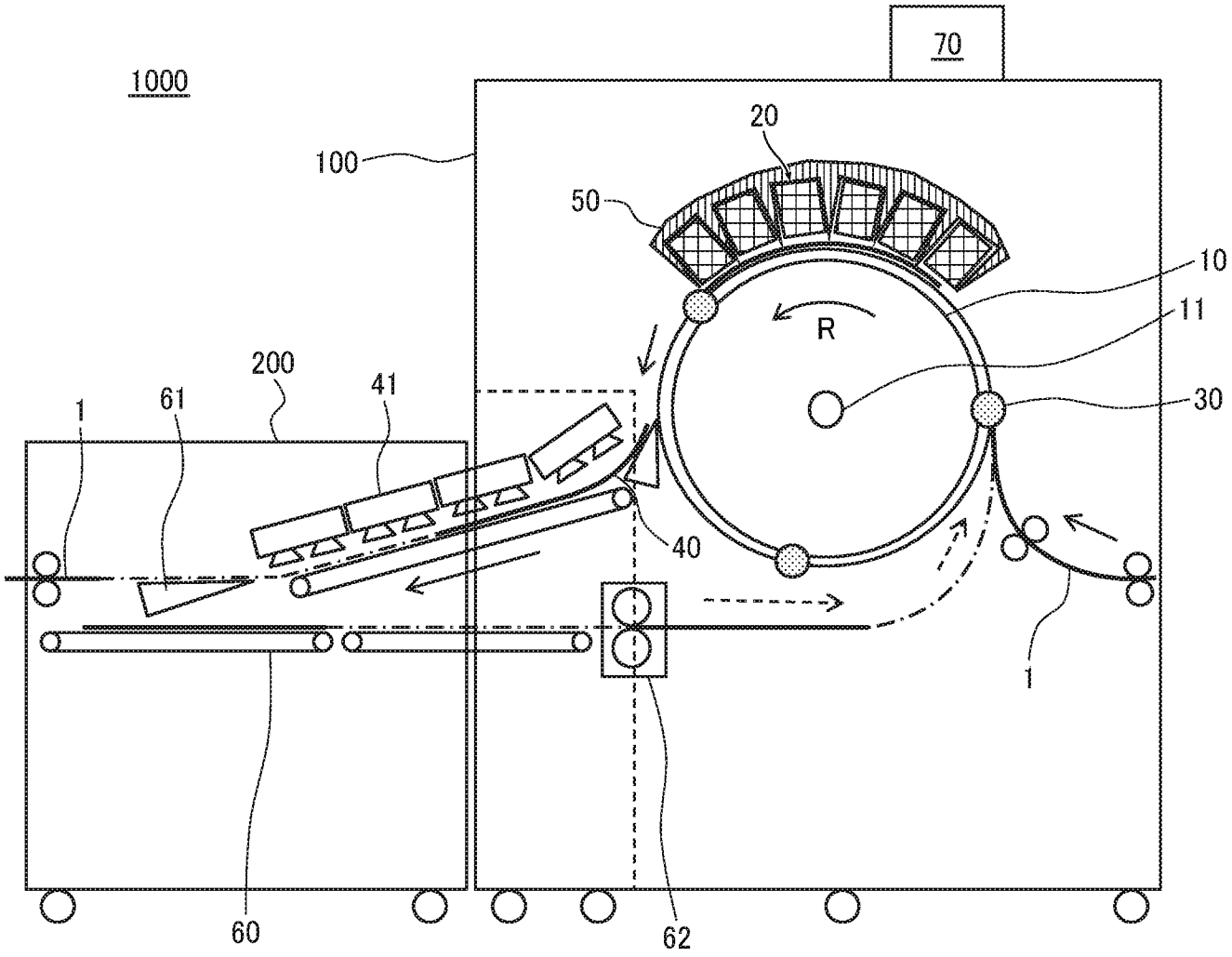
FIG. 1 is a schematic configuration view illustrating an embodiment of an image forming apparatus according to the present invention.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

The present invention relates to a head position adjustment mechanism used in an image forming apparatus including an inkjet printer. The head position adjustment mechanism refers to a structural unit that adjusts the position of a nozzle port of an inkjet head including a printing module with respect to the recording medium. The nozzle port is included in a recording head provided in the inkjet head. That is, the present invention relates to a head position adjustment mechanism that adjusts the position of the recording head.

The head position adjustment mechanism according to an embodiment of the present invention has, as one of advantageous points of the present invention, capability of adjusting two directions, namely, an array direction of ink droplet discharge ports (nozzles) of an image forming apparatus that discharges liquid ink or the like as droplets onto a recording medium being a sheet-like conveyed object, and an ink droplets discharge direction onto the recording medium. With the use of the head position adjustment mechanism according to an embodiment of the present invention, it is possible to adjust the array direction of the nozzles and the ink droplet discharge direction to the recording medium to be orthogonal to each other.

The head position adjustment mechanism according to an embodiment of the present invention can relax dimensional tolerance of the components constituting the printing module of the image forming apparatus, and can suppress the manufacturing cost of the components. Furthermore, in an image forming apparatus including a plurality of printing modules, the printing surface (where ink droplets adhere to the recording medium and an image is formed) and the ink discharge direction can be made substantially equally orthogonal to each other in any of the printing modules. Accordingly, this makes it possible to equalize discharge conditions in each of the printing modules and to simplify the discharge condition setting. Together with this, the nozzle array can be adjusted to be orthogonal to the conveyance direction of the recording medium, leading to achieving satisfactory image quality.

Embodiment of Image Forming Apparatus

First, an inkjet printer 100 according to an embodiment of an image forming apparatus of the present invention will be described with reference to FIG. 1. FIG. 1 is a configuration diagram illustrating a configuration of an image forming system 1000 including an inkjet printer 100 and a drying apparatus 200. The inkjet printer 100 according to the present embodiment is a printer that discharges ink, which is a liquid for image formation, onto a recording medium by an inkjet system to form an image.

The inkjet printer 100 includes a conveyance drum 10, a liquid discharge head device 20, and a display device 70. The conveyance drum 10 is a cylindrical member that conveys a sheet 1 as a recording medium so as to be held on its outer circumferential surface. The liquid discharge head device 20 is provided in plurality so as to correspond individually to the ink liquids of individual colors. Each of the liquid discharge head device 20 has a plurality of nozzles to discharge droplets, with a nozzle array being arranged to be orthogonal to a rotational direction of the conveyance drum 10. The liquid discharge head device 20 is a printing module that uses an inkjet system to discharge ink. The display device 70 displays information detected by a sensor included in the liquid discharge head device 20 or the like, and information to be used to control the inkjet printer 100.

The inkjet printer 100 further includes a beam 50 that holds the liquid discharge head device 20 so as to discharge ink droplets onto a recording surface of the sheet 1 to be conveyed. The beam 50 is positioned in a horizontal planar direction being a direction orthogonal to the conveyance direction of the sheet 1. The direction in which the beam 50 is positioned is also referred to as a main-scanning direction with respect to the sheet 1. The liquid discharge head device 20 is suspended by the beam 50 and held at a predetermined position and posture.

On a downstream side of the conveyance direction of the sheet 1 in the inkjet printer 100 (hereinafter, referred to as "sheet conveyance direction"), there is disposed a drying apparatus 200 for drying the sheet 1 on which an image is formed by the inkjet system. The drying apparatus 200 includes a sheet reverse conveyor 60 for further forming an image on a back surface of the sheet 1. A sheet ejector for ejecting the dried sheet 1 is provided on the further downstream side of the sheet reverse conveyor 60.

The image forming system 1000 may also include a sheet feeder that feeds the sheet 1 and a registration adjustment unit that performs registration correction of the sheet 1 on an upstream side of the sheet conveyance direction of the inkjet printer 100.

Next, a series of image forming operation for forming an image on the sheet 1 in the image forming system 1000 will be described. First, the sheets 1 separated and picked up one by one undergo registration correction in the registration adjustment unit and thereafter are conveyed to the inkjet printer 100 at a predetermined timing.

The leading end of the sheet 1 conveyed to the inkjet printer 100 is pinched by a gripper 30 provided on the surface of the conveyance drum 10, and the position of the sheet 1 on the surface of the conveyance drum 10 is determined. In addition, innumerable air suction holes are formed on the surface of the conveyance drum 10, and the entire sheet 1 can be held in close contact with the surface of the conveyance drum 10 by air suction from the back surface of the sheet 1.

Subsequently, the sheet 1 held in a state of being in close contact with the surface of the conveyance drum 10 is conveyed in the direction of the liquid discharge head device 20 as a result of the rotation of the conveyance drum 10 in a direction indicated arrow R of FIG. 1.

In the inkjet printer 100, units of the liquid discharge head device 20 are sequentially disposed along a circumferential surface of the conveyance drum 10 in a state of being filled with a predetermined liquid. Examples of the liquid filled in the liquid discharge head device 20 include inks of black, cyan, magenta, and yellow for color printing and a coating liquid for performing coating processing before or after the ink discharge to the sheet.

The sheet 1 held on the surface of the conveyance drum 10 is conveyed below the liquid discharge head device 20 of individual colors. Next, the ink and coating liquid of individual colors are discharged from the liquid discharge head device 20 to the sheet 1 at a predetermined timing, resulting in image formation on the sheet 1.

Grippers 30 for gripping the leading end of the sheet 1 are attached at three locations on the surface of the conveyance drum 10. With this configuration, it is possible to perform image formation on the three sheets 1 while the conveyance drum 10 makes one rotation about the drum rotation shaft 11.

The sheet 1 carrying an image formed by the inkjet printer 100 is conveyed to the drying apparatus 200 including a drying device 41. The sheet 1 passing below the drying device 41 makes it possible to allow the moisture in the ink to be evaporated, preventing curling of the sheet 1.

The drying apparatus 200 limiter includes a sheet reverser 61 and a sheet reverse conveyor 60. At the time of double-sided printing, the sheet 1 is reversed here, and then, the sheet 1 is conveyed to the inkjet printer 100 again. After the conveyance direction of the sheet 1 is switched at the sheet reverser 61, the sheet 1 is conveyed by the sheet reverse conveyor 60 in the direction of the inkjet printer 100. Before the sheet 1 reaches the conveyance drum 10, the registration of the sheet 1 is corrected by a registration roller pair 62.

After having registration correction, the sheet 1 is conveyed to the conveyance drum 10 and is pinched by the gripper 30 to be held on the surface of the conveyance drum 10 such that the back surface having no image formed faces the liquid discharge head device 20. Next, in the inkjet printer 100, droplets are discharged from the liquid discharge head device 20 to the back surface of the sheet 1 having no image formed held on the surface of the conveyance drum 10, and image formation is performed.

The sheet 1 having images formed on both sides passes through the drying apparatus 200, and is conveyed to the sheet ejector in a similar manner in any of single-sided printing and double-sided printing. In the sheet ejector, the sheets 1 are stacked in alignment. As described above, image formation and output is executed in the image forming system 1000 according to the present embodiment.

Suspension Structure of Liquid Discharge Head Device

Figure 2:
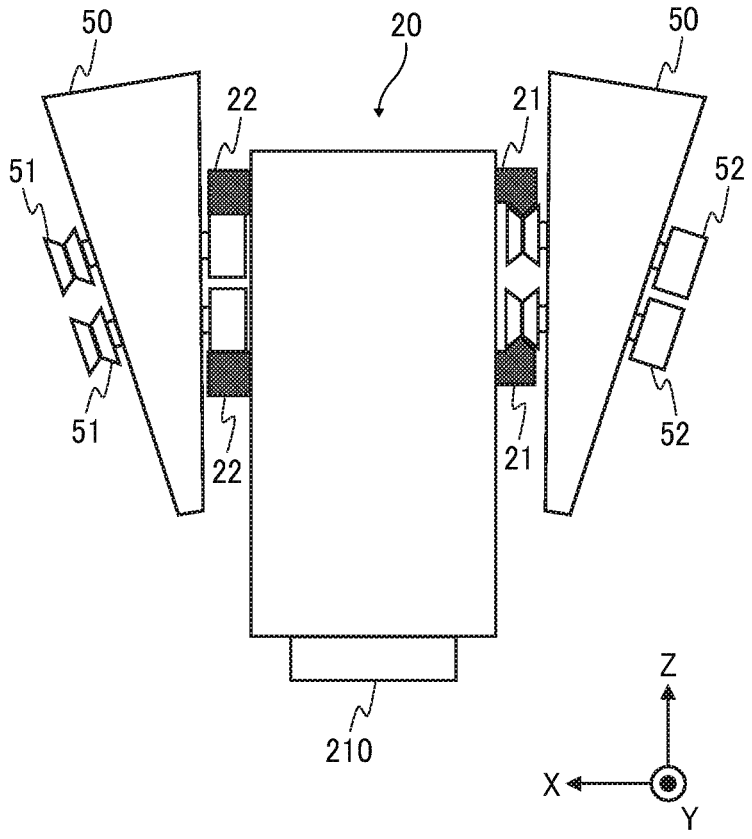
FIG. 2 is a configuration view illustrating a suspension structure of a head device including a head position adjustment mechanism according to the present embodiment.

Next, a structure in which the liquid discharge head device 20 according to the present embodiment is suspended on the beam 50 will be described with reference to FIG. 2. FIG. 2 illustrates a structure in which one liquid discharge head device 20 is suspended on the beam 50. The inkjet printer 100 described above includes a plurality of liquid discharge head devices 20. The beam 50 has a structure that suspends the plurality of liquid discharge head devices 20 independently. Accordingly, FIG. 2 illustrates a part of the beam 50 included in the inkjet printer 100 and one liquid discharge head device 20, forming the beam 50 as a structural unit having a structure connecting a plurality of these.

The liquid discharge head device 20 is a rectangular parallelepiped having an outer dimension equal to or longer than the dimension in the surface direction orthogonal to the conveyance direction of the sheet 1. Therefore, the beam 50 also has a depth equal to or greater than that of the liquid discharge head device 20. FIG. 2 is a view of the suspension structure of the liquid discharge head device 2C) illustrated from the end direction in the longitudinal direction of the rectangular parallelepiped.

Here, axes of the three-dimensional orthogonal coordinate system used in the following description will be described. The liquid discharge head device 20 houses a head 210 being a recording head having an array of discharge ports for discharging liquids. The head 210 housed in the liquid discharge head device 20 has a discharge port for discharging droplets. An axis in a direction of discharging liquid droplets from the head 210 will be referred to as a "Z axis". An axis parallel to the short direction of the surface having an array of the discharge ports in the head 210 and orthogonal to the Z axis will be referred to as an "X axis". An axis in a direction orthogonal to the X axis and the Y axis and parallel to the longitudinal direction of the array surface of the discharge ports will be referred to as a "Y axis". In addition, directions parallel to the individual axes will be referred to as an X direction, a Y direction, and a Z direction.

As illustrated in FIG. 2, the liquid discharge head device 20 discharges droplets in the −Z direction.

The sheet 1 on which an image is formed by the ink droplets discharged from the head 210 is conveyed in the +X direction illustrated in FIG. 2. Accordingly, the liquid discharge head device 20 including the head 210 forms an array surface of discharge ports in the form of a plane parallel to the X-Y plane formed in the "+X direction" being the conveyance direction of the sheet 1 and corresponding to the short direction in the outer shape of the case and in the "−Y direction" corresponding to the longitudinal direction in the outer shape of the case. The liquid discharge head device 20 has a predetermined height dimension in the "−Z direction" from the array surface of the discharge ports.

The liquid discharge head device 20 includes a V-shaped rail 21 having a V-shaped cross section provided on one side surface parallel to a Y-Z plane. On the other side surface, there is provided a flat rail 22 having a rectangular cross-sectional shape. The V-shaped rail 21 and flat rail 22 are provided in plurality at predetermined positions separated in the Z direction.

As illustrated in FIG. 2, a V-shaped roller 51 having a groove that fits with the V-shaped rail 21 is provided on an inner side surface of the beam 50 opposed to the side surface including the V-shaped rail 21. In addition, a flat roller 52 having an outer circumferential surface that fits with the flat rail 22 is provided on an inner side surface of the beam 50 opposed to the side surface including the flat rail 22. The V-shaped roller 51 and the flat roller 52 are provided at positions separated in the Z direction on the inner surface of the beam 50. The V-shaped rail 21 is provided so as to sandwich each of the two V-shaped rollers 51 in an up-down direction. The flat rail 22 is provided so as to sandwich each of the two flat rollers 52 in the up-down direction.

Accordingly, the liquid discharge head device 20 has a structure of being suspended and held by the V-shaped roller 51 and the flat roller 52 provided on the inner side surface of the beam 50, at a predetermined position with respect to the beam 50. The rails (V-shaped rail 21 and flat rail 22) provided in the liquid discharge head device 20 are respectively suspended by the rollers (V-shaped roller 51 and flat roller 52), and thus, the liquid discharge head device 20 slides in the −Y direction with respect to the beam 50. The liquid discharge head device 20 can move to and stop at a predetermined position, so as to be positioned relative to the beam 50.

First Embodiment

Head position adjustment mechanism of liquid discharge head device

Figure 3:
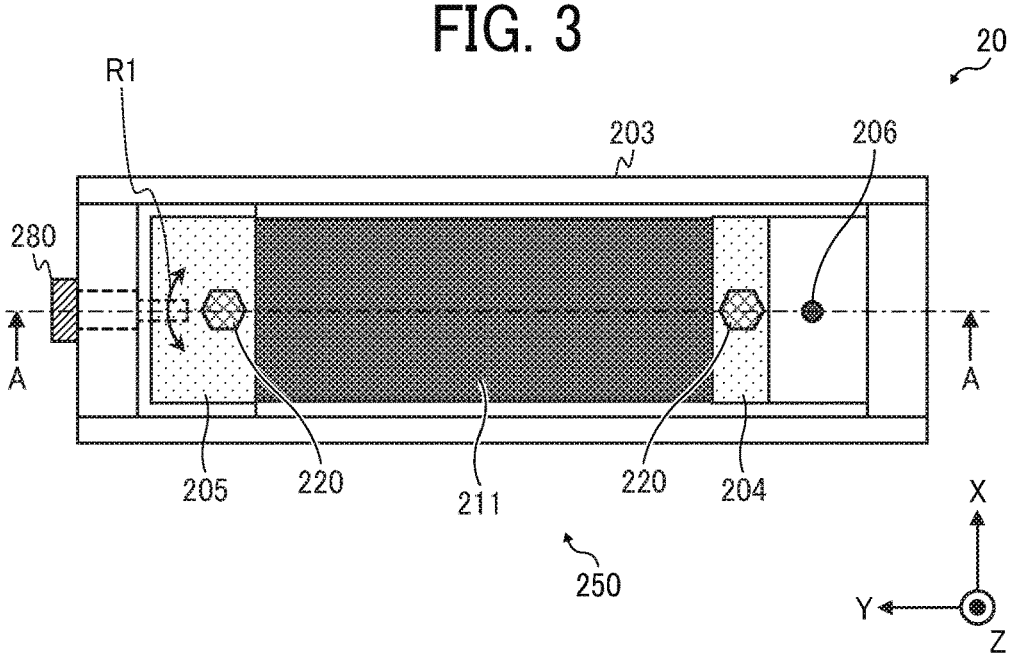
FIG. 3 is a plan view illustrating a configuration example of a head position adjustment mechanism according to the present embodiment.
Figure 4:
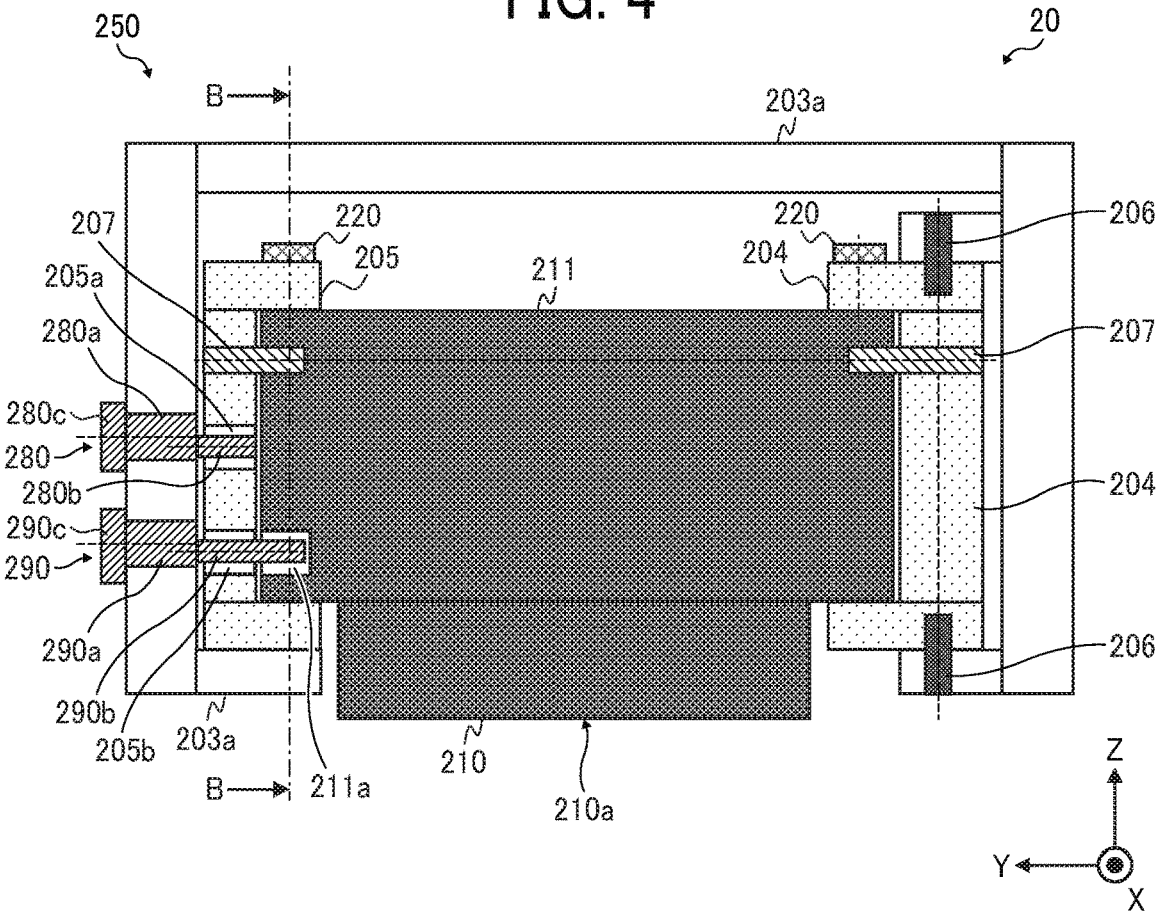
FIG. 4 is a cross-sectional side view of the head position adjustment mechanism when the configuration example illustrated in FIG. 3 is viewed from one direction.
Figure 5:
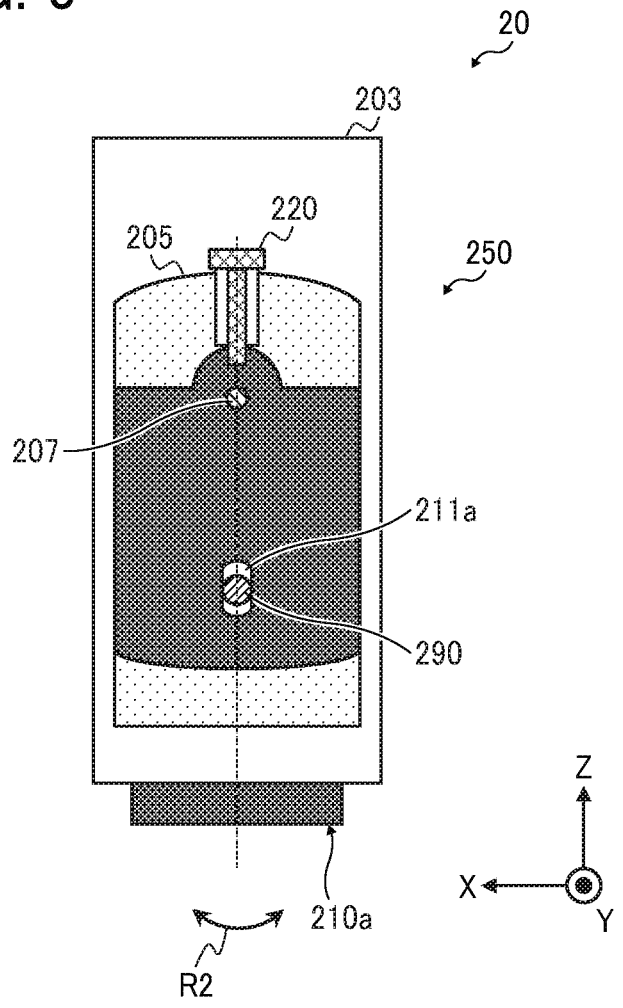
FIG. 5 is a side view of the head position adjustment mechanism in the configuration example illustrated in FIG. 3, as viewed from a direction different from the direction in FIG. 4.

Next, an embodiment of a head position adjustment mechanism according to the present invention will be described with reference to the drawings. A head adjustment mechanism 250 according to the present embodiment can adjust the position of the liquid discharge head device 20 and the direction of the discharge port (a nozzle surface 210*a*) of the head 210 with respect to the sheet 1. More specifically, the head adjustment mechanism 250 can adjust an angle formed between the ink discharge direction from the liquid discharge head device 20 and the recording medium surface, an angle formed between the array direction of the ink discharge ports provided on the nozzle surface 210*a* (see FIG. 4) of the liquid discharge head device 20 and the conveyance direction of the sheet 1, or the like. FIG. 3 is a top perspective view of a member (top plate 203*a* described below) of an upper surface portion from the top surface being the uppermost surface in the Z direction of the liquid discharge head device 20 including the head adjustment mechanism 250. FIG. 4 is a cross-sectional view taken along line A-A in FIG. 3. FIG. 5 is a cross-sectional view taken along line B-B in FIG. 4.

First, as observed from FIGS. 3, 4 and 5, the liquid discharge head device 20 has the outer shape of a rectangular parallelepiped enclosing internal configurations by an outer case 203. The head 210 constituting the recording head is housed inside the outer case 203 of the rectangular parallelepiped. Accordingly, inclination of the head 210 and the array direction of the nozzle array provided in the head 210 can be adjusted by the head adjustment mechanism 250 provided in the liquid discharge head device 20. The V-shaped rail 21 and the flat rail 22 described above are installed on a side surface of a portion of the outer case 203.

As illustrated in FIGS. 3 and 4, an inner rear case 204 is disposed in the vicinity of a rear (−V direction) inner wall inside the outer case 203 of the liquid discharge head device 20. The inner rear case 204 is held with respect to a site protruding in the +Y direction from the rear inner wall of the outer case 203 via a nozzle array direction adjustment fulcrum shaft 206 being a horizontal direction adjustment fulcrum shaft and being a first rotation shaft. The nozzle array direction adjustment fulcrum shaft 206 being the first rotation shaft extends in the Z direction being a droplet discharge direction. The inner rear case 204 is held in a horizontally rotational state (in a direction along the X-Y plane) with respect to the outer case 203 about the nozzle array direction adjustment fulcrum shaft 206 as a rotation shaft.

In addition, an inner front case 205 is disposed inside the outer case 203 on the +Y side. The inner front case 205 is held at a predetermined position in a state of being in contact with a bottom surface portion 203*b* constituting a part of the bottom surface of the outer case 203.

A hole (first hole) is formed in the +Y side outer wall being the front surface of the outer case 203. An outer case fitting boss 280*a* constituting a portion of a nozzle array direction adjustment eccentric 280 being a first eccentric shaft is fitted to the first hole. This allows the nozzle array direction adjustment eccentric 280 to be fitted to the outer case 203. Furthermore, an inner case fitting hole 205*a* is formed in the inner front case 205. An inner case fitting boss 280*b* constituting a portion of the nozzle array direction adjustment eccentric 280 is fitted to the inner case fitting hole 205*a*. The outer case fitting boss 280*a* and the inner case fitting boss 280*b* are integrally configured.

The center axis (axis in the Y direction) of the outer case fitting boss 280*a* and the center axis (axis in the Y direction) of the inner case fitting boss 280*b* are not coaxial. As illustrated in FIG. 4, these two axes are not coaxially arranged. That is, the inner case fitting boss 280*b* is eccentrically arranged with respect to the outer case fitting boss 280*a*. Due to this eccentricity, when the nozzle array direction adjustment eccentric 280 is rotated, a rotational force with the nozzle array direction adjustment fulcrum shaft 206 as a rotation shaft can be applied to the inner front case 205. The inner case fitting hole 205*a* is a vertically long hole having a width (dimension in the X direction) in sliding engagement with the inner case fitting boss 280*b* and having a height (dimension in the Z direction) longer than the width.

Ahead holding case 211 has its rear end (end on the −Y side) fastened to the inner rear case 204 by a bolt 220. In addition, the head holding case 211 has its front end (end on the +Y, side) fastened to the inner front case 205 by the bolt 220. The bearing surface of the bolt 220 includes a pressure sensor such as a pressure detection sheet capable of detecting contact pressure of the bolt 220. Therefore, when the bolt 220 is tightened, the contact pressure of the bearing surface of the bolt 220 is detected by the pressure sensor. Detection results can be displayed on the display device 70 including an operation panel. This display can indicate that the nozzle array direction adjustment can be performed.

The display device 70 visually displays information indicating that any one or both of the rotation of the head holding case 211 by the nozzle array direction adjustment fulcrum shaft 206 and the rotation of the head holding case 211 at a nozzle direction adjustment fulcrum shaft 207 can be performed. Specifically, the nozzle array direction adjustment eccentric 280 and a vertical direction adjustment eccentric 290 are displayed as a figure or the like on the display device 70. Furthermore, information indicating that operating the nozzle array direction adjustment eccentric 280 can adjust the head holding case 211 in a direction indicated by arrow R1 in FIG. 3 and that operating the vertical direction adjustment eccentric 290 can adjust the head holding case 211 in a direction indicated by arrow R2 in FIG. 5 is displayed on the display device 70. Visually displaying the adjustment direction facilitates adjustment operation. The above information may be displayed in the vicinity of the nozzle array direction adjustment eccentric 280 and the vertical direction adjustment eccentric 290 of the liquid discharge head device 20 instead of adopting the configuration including the display device 70. The display method is not limited to the electronic method using a panel or the like, and the front surface of the head device may be marked or the like.

The head 210 is fastened to and held by the head holding case 211 as a holder. The direction of discharging ink droplets from the head 210 is the −Z direction. The nozzle surface 210*a* having an array of discharge ports of ink droplets is arranged on an end surface on the −Z side of the head 210 and parallel to the X-Y plane.

When the nozzle array direction adjustment eccentric 280 is rotated in the liquid discharge head device 20 having the above-described configuration, the head holding case 211 can be moved with the nozzle array direction adjustment fulcrum shaft 206 extending in the droplet discharge direction as a fulcrum, in the direction indicated by arrow R1 illustrated in FIG. 3. That is, rotating the nozzle array direction adjustment eccentric 280 makes it possible to move the head holding case 211 so that the nozzle surface 210*a* moves in a direction along the X-Y plane being a direction parallel to the array surface of the discharge ports. With this configuration, it is possible to adjust the inclination of the Y axis in the plane of the nozzle surface 210*a*, that is, the inclination of the array direction of the discharge ports. After the adjustment, the nozzle array direction adjustment eccentric 280 can be secured so as not to rotate by the presence of a detent 230 (see FIG. 6) provided in the nozzle array direction adjustment eccentric 280.

The head holding case 211 is engaged so as to be rotatable in a direction parallel to the X-Z plane with respect to the inner rear case 204 and the inner front case 205 by the nozzle direction adjustment fulcrum shaft 207 being a vertical direction adjustment fulcrum shaft and being a second rotation shaft. The nozzle direction adjustment fulcrum shaft 207 being the second rotation shaft extends in the Y direction being a longitudinal direction of the head.

The +Y side outer wall being the front surface of the outer case 203 has a hole (second hole) different from the hole (first hole) to which the nozzle array direction adjustment eccentric 280 is to be fitted. An outer case fitting boss 290*a* constituting a portion of the vertical direction adjustment eccentric 290 which is a second eccentric shaft is fitted to the second hole. This allows the vertical direction adjustment eccentric 290 to be fitted to the outer case 203.

Furthermore, a vertical direction adjustment eccentric through hole 205*b* is formed in the inner front case 205. An inner case fitting boss 290*b* constituting a portion of the vertical direction adjustment eccentric 290 is fitted to the vertical direction adjustment eccentric through hole 205*b*. The outer case fitting boss 290*a* and the inner case fitting boss 290*b* are integrally configured.

A portion in the vicinity of the tip of the inner case fitting boss 290*b* is fitted to a head holding case fitting hole 211*a* formed with a predetermined depth dimension from the +Y side side surface of the head holding case 211.

The Y-direction axis of the outer case fitting boss 290*a* and the Y-direction axis of the inner case fitting boss 290*b* are not coaxial. Therefore, the inner case fitting boss 290*b* is eccentrically arranged with respect to the outer case fitting boss 290*a*. Due to this eccentricity, when the vertical direction adjustment eccentric 290 is rotated, a rotational force having the nozzle direction adjustment fulcrum shaft 207 as a rotation shaft can be applied to the head holding case 211. The head holding case fitting hole 211*a* is a vertically long hole having a width (dimension in the X direction) in sliding engagement with the inner case fitting boss 290*b* and having a height (dimension in the Z direction) longer than the width.

The vertical direction adjustment eccentric through hole 205*h* provided in the inner front case 205 is a hole with dimension that suppresses contact of the inner case fitting boss 290*b* even when the vertical direction adjustment eccentric 290 is rotated. Even when the nozzle array direction adjustment eccentric 280 is turned to move the inner front case 205, the inner case fitting boss 290*b* of the vertical direction adjustment eccentric 290 and the vertical direction adjustment eccentric through hole 205*b* would not come in contact with each other. That is, when the nozzle array direction adjustment eccentric 280 is operated to rotate the inner front case 205 and the head holding case 211, the vertical direction adjustment eccentric 290 does not interfere with the rotating operation.

When the bolt 220 is loosened and thereafter the vertical direction adjustment eccentric 290 is rotated in the liquid discharge head device 20 having the above configuration, it is possible to move the head holding case 211 in the direction indicated by arrow R2 (see FIG. 5) with the nozzle direction adjustment fulcrum shaft 207 extending in the longitudinal direction of the head as a fulcrum. That is, with rotation of the vertical direction adjustment eccentric 290, the head holding case 211 can be moved in the direction orthogonal to the array surface of the discharge ports. With this configuration, it is possible to adjust the inclination of the Z axis, that is, the inclination of the ink discharge direction.

With the configuration described above, it is possible to perform adjustment in the Z direction (vertical direction) in a unit of "head 210+head holding case 211", that is, with the head 210 and the head holding case 211 integrated with each other. In addition, it is possible to perform adjustment of altering the nozzle array direction in a unit of "head 210+head holding case 211+inner case (inner front case 205 and inner rear case 204)", that is, with the head 210, head holding case 211, and inner front case 205, and the inner rear case 204 integrated with each other. The head 210 and the head holding case 211 may be configured as an integrated member. Each of the adjustments can be performed independently. When one adjustment is being performed, the other adjustment mechanism (adjuster) does not interfere.

That is, the head adjustment mechanism 250 can perform any one or both of adjustment by rotation in the unit of "head 210+head holding case 211", and adjustment by rotation in the unit of "head 210+head holding case 211+inner case (inner front case 205 and inner rear case 204)".

The liquid discharge head device 20 includes: the head 210 having a nozzle port for discharging ink droplets onto the sheet 1; the head holding case 211 as a first holder for holding the head 210; the inner rear case 204 and the inner front case 205 as second holders for holding the head holding case 211; and the outer case 203 as a third holder for holding the inner rear case 204 and the inner front case 205.

The inner rear case 204 and the inner front case 205 are rotatable with respect to the outer case 203 about the nozzle array direction adjustment fulcrum shaft 206 as the first rotation shaft extending in the droplet discharge direction (Z direction) as a first direction.

The head holding case 211 is rotatable with respect to the inner rear case 204 and the inner front case 205 about the nozzle direction adjustment fulcrum shaft 207 as the second rotation shaft extending in the head longitudinal direction (Y direction) as a second direction different from the droplet discharge direction.

With these configurations, the liquid discharge head device 20 can rotate the head 210 in two directions with a simple configuration, and can adjust its posture. More preferably, the extending directions of the nozzle array direction adjustment fulcrum shaft 206 and the nozzle direction adjustment fulcrum shaft 207 would be orthogonal to each other. This would make it possible to simplify the adjustment mechanism (adjuster) of the head 210. The first direction and the second direction described above may be opposite to each other. The first direction may be set to the head longitudinal direction (Y direction), and the second direction may be set to the droplet discharge direction (Z direction).

Furthermore, the liquid discharge head device 20 has the above-described dimension of the vertical direction adjustment eccentric through hole 205*h*, making it possible to eliminate necessity to put restriction on the adjustment order of the nozzle array direction adjustment and the vertical direction adjustment.

The nozzle array direction adjustment eccentric 280 can be smoothly adjusted when it is provided at a center position of the inner front case 205 in the up-down direction. Providing the vertical direction adjustment eccentric 290 above the nozzle array direction adjustment eccentric 280 makes it possible to increase a "L2" (see FIG. 8) described later. With this configuration, it is possible to perform fine adjustment in the vertical direction.

Each of the nozzle array direction adjustment eccentric 280 being the first eccentric shaft and the vertical direction adjustment eccentric 290 being the second eccentric shaft is provided to protrude on the +V side outer wall being the front surface of the outer case 203. This protrusion corresponds to an operation device used to operate the nozzle array direction adjustment eccentric 280 and the vertical direction adjustment eccentric 290. As illustrated in FIGS. 3 and 5, the operation device is provided on a surface on a side from which the liquid discharge head device 20 is pulled out from the beam 50 as a member holding the liquid discharge head device 20 among side surfaces of the liquid discharge head device 20. With this configuration, it is possible to visually confirm the adjustment direction in the adjustment of the position of the head 210. This allows more effective adjustment to be performed easily without making a mistake in adjustment operation.

Coarse adjustment mechanism and fine adjustment mechanism of head position adjustment mechanism of liquid discharge head device Next, the "coarse adjustment mechanism" and the "fine adjustment mechanism" in the head adjustment mechanism 250 of the liquid discharge head device 20 according to the present embodiment will be described with reference to FIGS. 6 and 7. Here, the "coarse adjustment mechanism" and the "fine adjustment mechanism" to be described are included in the nozzle array direction adjustment eccentric 280 described above. The vertical direction adjustment eccentric 290 may also have a similar mechanism.

Figure 6:
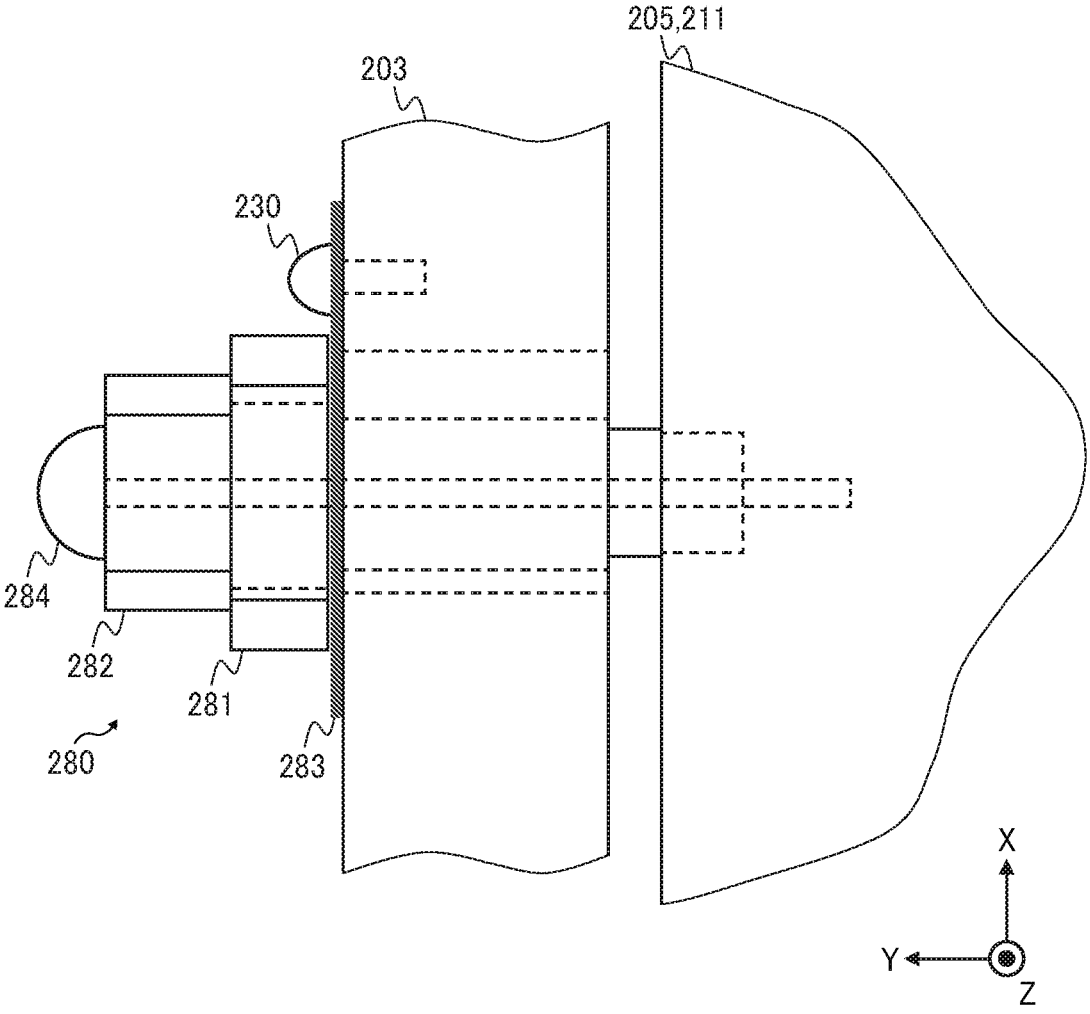
FIG. 6 is a configuration view illustrating a configuration of a coarse adjustment mechanism and a fine adjustment mechanism provided in the head position adjustment mechanism according to the present embodiment.

As illustrated in FIG. 6, the nozzle array direction adjustment eccentric 280 in the liquid discharge head device 20 includes: a coarse adjustment shaft member 281 constituting a coarse adjuster; a fine adjustment shaft member 282 constituting a fine adjuster; a washer 283; and a shaft member 284. The washer 283 is secured to the outer case 203 by the detent 230. The detent 230 and the washer 283 works to secure the nozzle array direction adjustment eccentric 280 so as not to rotate.

Figure 7:
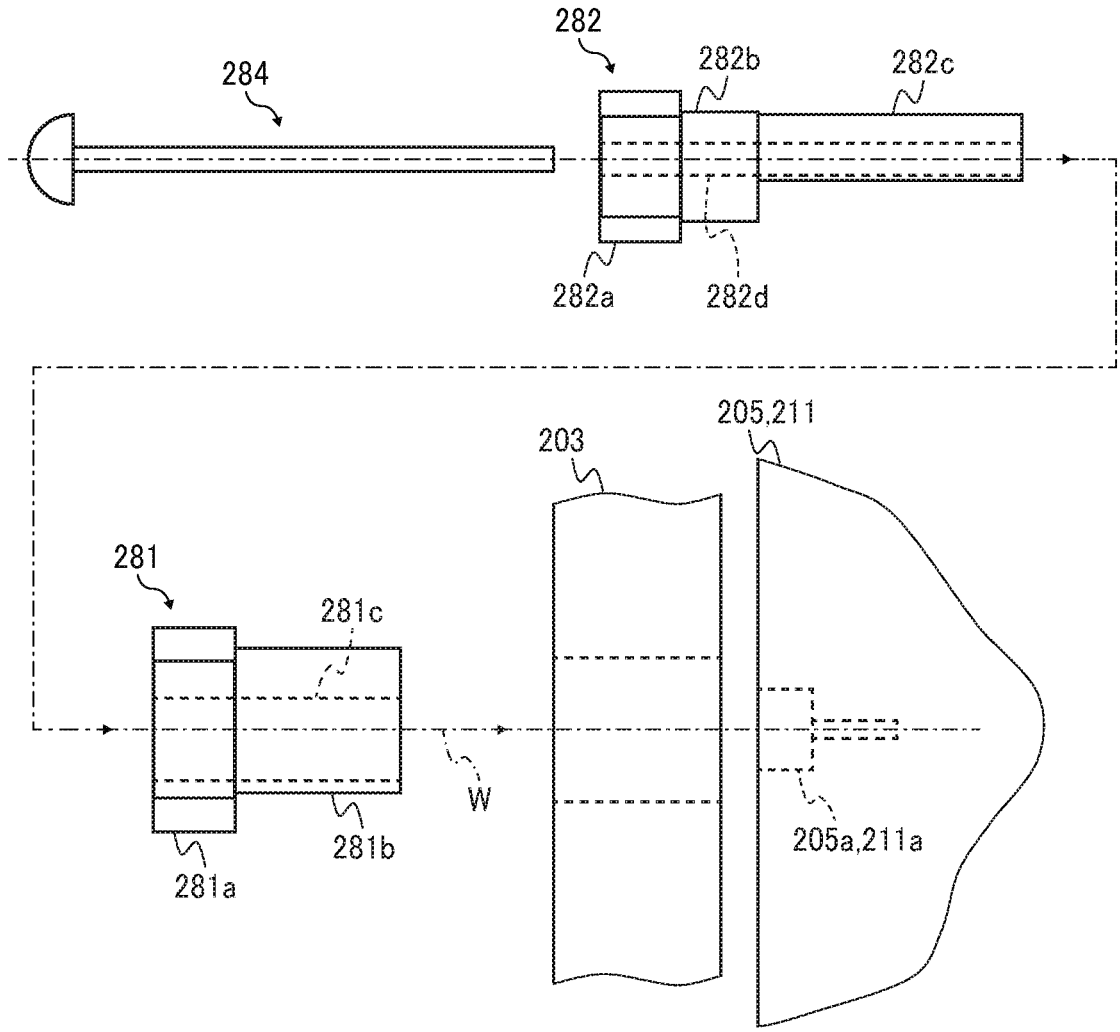
FIG. 7 is a configuration view illustrating a detailed configuration of the coarse adjustment mechanism and the fine adjustment mechanism according to the present embodiment.

As illustrated in FIG. 7, the coarse adjustment shaft member 281 includes a first eccentric boss 281*b* as a first eccentric member having high eccentricity with respect to a rotation center axis W (illustrated by a one-dot chain line in FIG. 7) of the nozzle array direction adjustment eccentric 280 being an adjustment member. The fine adjustment shaft member 282 includes a second eccentric boss 282*c* as a second eccentric member having low eccentricity with respect to the rotation center axis W of the nozzle array direction adjustment eccentric 280. The first eccentric boss 281*b* allows the nozzle array direction adjustment eccentric 280 to be eccentric with respect to the rotation center axis W by a predetermined level of eccentricity. In contrast, a second eccentric boss 281*c* allows the nozzle array direction adjustment eccentric 280 to be eccentric with respect to the rotation center axis W by eccentricity lower than the eccentricity of the first eccentric boss 281*b*.

According to the nozzle array direction adjustment eccentric 280 having the above configuration, the head holding case 211 can be pivoted in a large amount in the case of the coarse adjustment shaft member 281 and can be pivoted in a small mount in the case of the fine adjustment shaft member 282 even when the head holding case 211 is rotated by the same rotation angle. Therefore, adjustment of the pivoting angle of the head holding case 211 (position adjustment of the head 210) can be performed efficiently and accurately.

Second Embodiment

Figure 8:
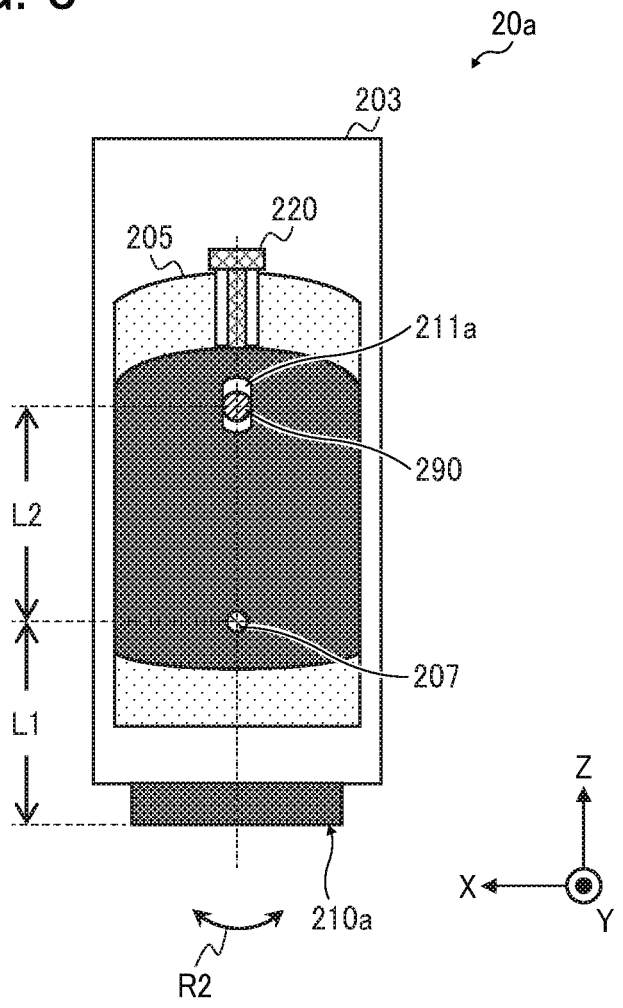
FIG. 8 is a side view illustrating another configuration example of the head position adjustment mechanism according to the present embodiment.

Next, another embodiment of the liquid discharge head device 20 will be described. The liquid discharge head device 20*a* illustrated in FIG. 8 has a configuration in which the nozzle direction adjustment fulcrum shaft 207 is disposed in the vicinity of the nozzle surface 210*a*, and the vertical direction adjustment eccentric 290 is disposed at a distant position from the nozzle surface 210*a*. Similarly to FIG. 5, FIG. 8 is a cross-sectional view of the liquid discharge head device 20*a* at a position corresponding to line B-B illustrated in FIG. 4.

When an adjustment amount in the vertical direction adjustment eccentric 290 is δ, a movement amount Δ of the nozzle surface 210*a* is calculated by a ratio of a distance L1 between the nozzle direction adjustment fulcrum shaft 207 and the nozzle surface 210*a* to a distance L2 between the nozzle direction adjustment fulcrum shaft 207 and the vertical direction adjustment eccentric 290. That is, the movement amount Δ is equal to a value obtained by multiplying the ratio of the distance L1 to the distance L2 by the adjustment amount $\delta(\Delta=\delta*(L1/L2))$. Accordingly, finer adjustment is possible by making L2 longer than L1 (L2>L1).

With the configuration of providing the nozzle array direction adjustment eccentric 280 and the vertical direction adjustment eccentric 290 described above on the same surface on the pull-out side (the +Y side being the front surface) of the liquid discharge head device 20, it is possible to facilitate operation of the adjustment mechanism for adjusting the position and inclination of the liquid discharge head device 20, enabling easy adjustment of the position of the liquid discharge head device 20.

With the inkjet printer 100 being an image forming apparatus including the liquid discharge head device 20 described above, the position and the inclination of the liquid discharge head device 20 can be easily adjusted with respect to the sheet 1. Although the inkjet printer 100 according to the present embodiment illustrated above includes the plurality of liquid discharge head devices 20, the head adjustment mechanism 250 described above can also be applied to the inkjet printer 100 including one liquid discharge head device 20.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A head device comprising:

a head having a discharge port to discharge droplets to a medium;

a holder configured to hold the head and be rotatable about a first rotation shaft extending in a discharge direction of the droplets and rotatable about a second rotation shaft extending in a longitudinal direction of the head; and an adjuster including:

a first eccentric shaft configured to apply a rotational force about the first rotation shaft to the holder; and a second eccentric shaft configured to apply a rotational force about the second rotation shaft to the holder.

2. The head device according to claim 1, wherein rotation of the holder about the first rotation shaft and rotation of the holder about the second rotation shaft are independent of each other.

3. The head device according to claim 1,
wherein the second eccentric shaft does not interfere with a rotational movement of the holder when the holder rotates about the first eccentric shaft.

4. The head device according to claim 1,
wherein the adjuster includes:
a first eccentric member having a first eccentricity with respect to a rotation center axis of the adjuster, and
a second eccentric member having a second eccentricity lower than the first eccentricity of the first eccentric member with respect to the rotation center axis.

5. The head device according to claim 1,
wherein a distance between the second eccentric shaft and a nozzle surface of the head including the discharge port is shorter than a distance between the first eccentric shaft and the nozzle surface.

6. The head device according to claim 1,
wherein a distance between a nozzle surface of the head including the discharge port and the second rotation shaft is longer than a distance between the second rotation shaft and the adjuster.

7. The head device according to claim 1, further comprising an operation portion configured to operate the first eccentric shaft and the second eccentric shaft,
wherein the operation portion is disposed on a side of the head device from which the head device is to be pulled out from a member holding the head device.

8. The head device according to claim 1, further comprising a display device configured to display information indicating that one or both of rotation of the holder by the first rotation shaft and rotation of the holder by the second rotation shaft are executable.

9. An image forming apparatus comprising:
the head device according to claim 1; and
a conveyor configured to convey a medium.

10. The image forming apparatus according to claim 9, comprising a plurality of head devices including the head device,
wherein positions of heads of the plurality of head devices are adjustable independently of each other.

11. A head device comprising:
a head having a discharge port to discharge droplets to a medium;
a first holder configured to hold the head;
a second holder configured to hold the first holder; and
a third holder configured to hold the second holder,
wherein the second holder is rotatable, with respect to the third holder, about a first rotation shaft extending in a first direction, and the first holder is rotatable, with respect to the second holder, about a second rotation shaft extending in a second direction different from the first direction.

12. The head device according to claim 11,
wherein the first direction and the second direction are orthogonal to each other.

13. The head device according to claim 11,
wherein the first direction is a discharge direction of the droplets.

14. The head device according to claim 11,
wherein the second direction is a longitudinal direction of the head.

15. A head position adjustment mechanism configured to adjust a position of a head device including a head, the head including discharge ports to discharge droplets onto a medium, the head position adjustment mechanism comprising:
a first rotation shaft serving as a fulcrum of rotation to alter, with respect to the medium, a direction in which the discharge ports are arrayed;
a second rotation shaft serving as a fulcrum of rotation to incline, with respect to the medium, a nozzle surface in which the discharge ports are arrayed;
an adjuster including:
a first eccentric shaft configured to apply a rotational force about the first rotation shaft; and
a second eccentric shaft configured to apply a rotational force about the second rotation shaft.

* * * * *